United States Patent [19]

Sasaki

[11] Patent Number: 4,916,276

[45] Date of Patent: Apr. 10, 1990

[54] PUSH LOCK MECHANISM

[75] Inventor: Shiniji Sasaki, Miyagi, Japan

[73] Assignee: Alps Electric Co.,, Tokyo, Japan

[21] Appl. No.: 204,440

[22] Filed: Jun. 9, 1988

[30] Foreign Application Priority Data

Aug. 6, 1987 [JP] Japan ..... 62-119753[U]

[51] Int. Cl.[4] ..... H01H 3/42

[52] U.S. Cl. ..... 200/524; 74/110; 200/531; 200/536; 200/539; 200/565; 200/571

[58] Field of Search ..... 200/523, 524, 530, 531, 200/534, 536, 318.1, 341, 564, 565, 570, 571, 16 C, 519, 538, 539, 540, 541; 74/110 X

[56] References Cited

U.S. PATENT DOCUMENTS

| | | | |
|---|---|---|---|
| 3,639,714 | 2/1972 | Fujimoto et al. | 200/524 X |
| 3,704,353 | 11/1972 | Halla | 200/524 |
| 4,071,720 | 1/1978 | Krujci et al. | 200/565 X |
| 4,449,022 | 5/1984 | Uno et al. | 200/524 |
| 4,467,159 | 8/1984 | Ota et al. | 200/524 |
| 4,528,545 | 7/1985 | Lang | 200/565 |
| 4,616,116 | 10/1986 | Sato | 200/523 X |
| 4,636,601 | 1/1987 | Tanabe | 200/524 |

*Primary Examiner*—Ernest G. Cusick

*Attorney, Agent, or Firm*—Guy W. Shoup; Paul J. Winters

[57] ABSTRACT

A push lock mechanism including a heart-shaped cam groove, a driving pin adapted to trace in the heart-shaped cam groove, and an axially reciprocatable operation shaft adapted to be locked in a depressed position thereof by cooperation of the heart-shaped cam groove and the driving pin. The improvement comprising a slider having the heart-shaped cam groove on its peripheral surface and arranged around the operation shaft, a first return spring for biasing the slider in a reverse direction of the operation shaft, a driving member provided so as to project therefrom for transmitting power between the operation shaft and the slider, and a second return spring for biasing the driving member in such a direction as to urge the same against the slider, which second return spring has a spring force set to be smaller than a spring force of the first return spring, wherein when the operation shaft under a locked condition of the slider is moved in the reverse direction, the driving member is moved away from the slider to release abutment of the driving member against the slider.

2 Claims, 3 Drawing Sheets

(a)

(b)

PUSH LOCK MECHANISM

BACKGROUND OF THE INVENTION

The present invention relates to a push lock mechanism employable for a push switch or the like, and more particularly to a push lock mechanism using a cam lock mechanism consisting of a heart-shaped cam groove and a driving pin for locking an operation shaft when the shaft is pushed once and releasing the locked position when the shaft is pushed again.

In this type of push lock mechanism as known, a slider having the heart-shaped cam groove on its peripheral surface is fixed to the operation shaft, and the driving pin is rockably supported to a case in opposed relationship to the slider. The driving pin is designed to trace in the heart-shaped cam groove in association with the reciprocating motion of the slider. In operation, when the operation shaft is pushed (moved forwardly) against a return spring, the driving pin is shifted to a locked position in the heart-shaped cam groove to thereby lock the operation shaft with the slider in the depressed position. When the operation shaft is pushed again under the locked condition, the driving pin is shifted to an unlocked position in the heart-shaped cam groove to thereby release the locked condition of the operation shaft. Then, the operation shaft is returned (moved reversely) to its original position. In the case that a sliding contact is provided on the slider, and a contact adapted to contact the sliding contact is provided on the case, for example, a switching operation between the contact and the sliding contact may be effected by operating the operation shaft. Furthermore, a switched condition may be maintained by the locking operation as mentioned above.

However, in the conventional push lock mechanism, when the operation shaft is pulled under the locked condition, the slider is also pulled together with the operation shaft. Accordingly, undue force is applied to the engaged portion between the heart-shaped cam groove and the driving pin, causing breakage of a cam surface of the heart-shaped cam groove and deformation of the driving pin. As a result, the subsequent locking operation is rendered unreliable. To cope with this problem, a handle to be mounted on the operation shaft has been designed in such a shape that the handle cannot be easily pulled by an operator. However, there remains a possibility that the handle could be pulled. Thus, it is considered that such measures cannot reliably protect the push lock mechanism. In addition, there is another problem that the design of the handle is limited.

SUMMARY OF THE INVENTION

Accordingly, it is an object of the present invention to provide a push lock mechanism which may prevent the deformation of the driving pin and the breakage of the heart-shaped cam groove even when the operation shaft is pulled under the locked condition, thereby ensuring a reliable locking operation for a long period of time.

According to the present invention, there is provided in a push lock mechanism including a heart-shaped cam groove, a driving pin adapted to trace in the heart-shaped cam groove, and an axially reciprocatable operation shaft adapted to be locked in a depressed position thereof by cooperation of the heart-shaped cam groove and the driving pin, the improvement comprising a slider having the heart-shaped cam groove on its peripheral surface and arranged around the operation shaft, a first return spring for biasing the slider in a reverse direction of the operation shaft, a driving member provided so as to project therefrom for transmitting power between the operation shaft and the slider, and a second return spring for biasing the driving member in such a direction as to urge the same against the slider, said second return spring having a spring force set to be smaller than a spring force of the first return spring, wherein when the operation shaft under a locked condition of the slider is moved in the reverse direction, the driving member is moved away from the slider to release abutment of the driving member against the slider.

In operation, when the operation shaft is pushed, the pushing force applied to the operation shaft is transmitted through the driving member to the slider. As a result, the driving pin is moved to trace in the heart-shaped cam groove to lock the slider in the depressed position. When the operation shaft is pulled under the locked condition of the slider, the operation shaft and the driving member are reversely moved together, but the slider is maintained in the locked condition because of the engagement of the driving pin with the heart-shaped cam groove. Thus, the driving member is moved away from the slider. Accordingly, the pulling force applied to the operation shaft is not transmitted to the slider, and no undue force is applied to the heart-shaped cam groove and the driving pin. Thereafter, when the pulling force is removed, the operation shaft and the driving member are moved forwardly by the spring force of the second return spring to the abutting position of the driving member against the slider. Thereafter, when the operation shaft is pushed again, the driving pin is moved to an unlocked position in the heart-shaped cam groove. As a result, all of the slider, the driving member and the operation shaft are returned to the original position.

Other objects and features of the invention will be more fully understood from the following detailed description and appended claims when taken with the accompanying drawings.

BRIEF DESCRIPTION OF THE DRAWINGS

FIG. 3(*b*) is a vertical sectional view of the essential part of the push lock mechanism under the condition where the operation shaft is pulled under the locked condition.

DETAILED DESCRIPTION OF THE PREFERRED EMBODIMENT

Figure 1:
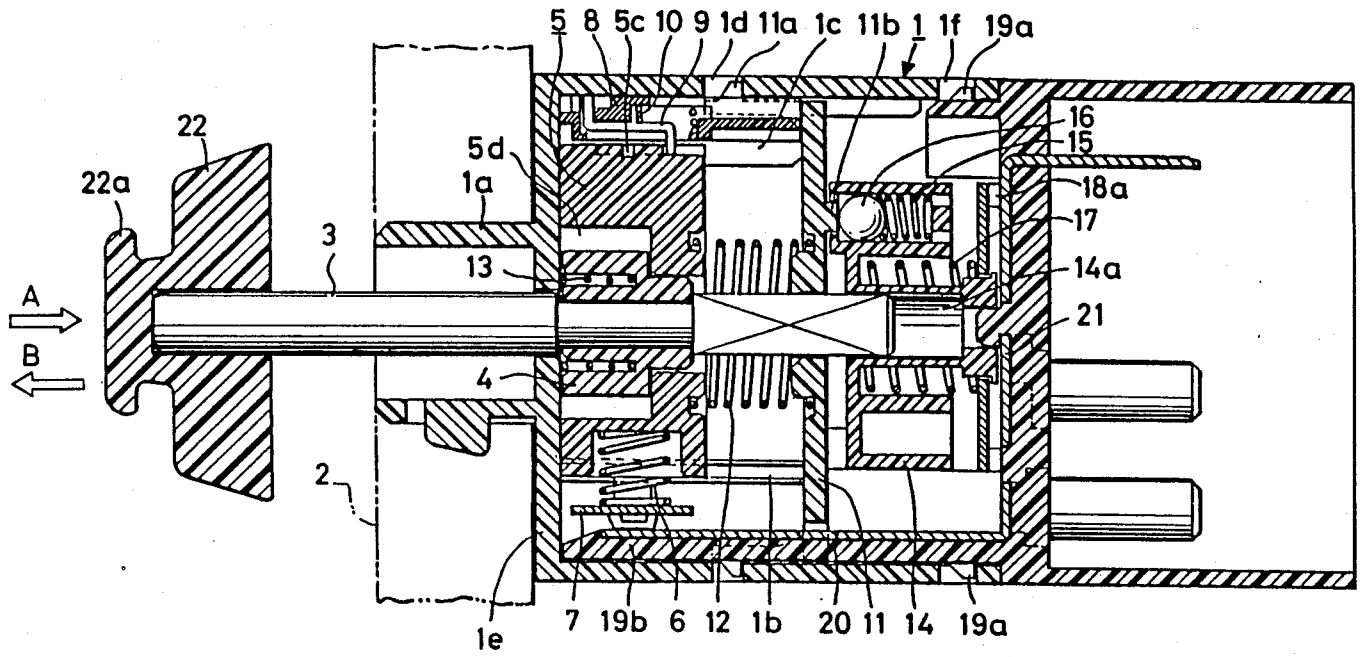
FIG. 1 is a vertical sectional view of the push lock mechanism under the unlocked condition according to a preferred embodiment of the present invention.
Figure 2:
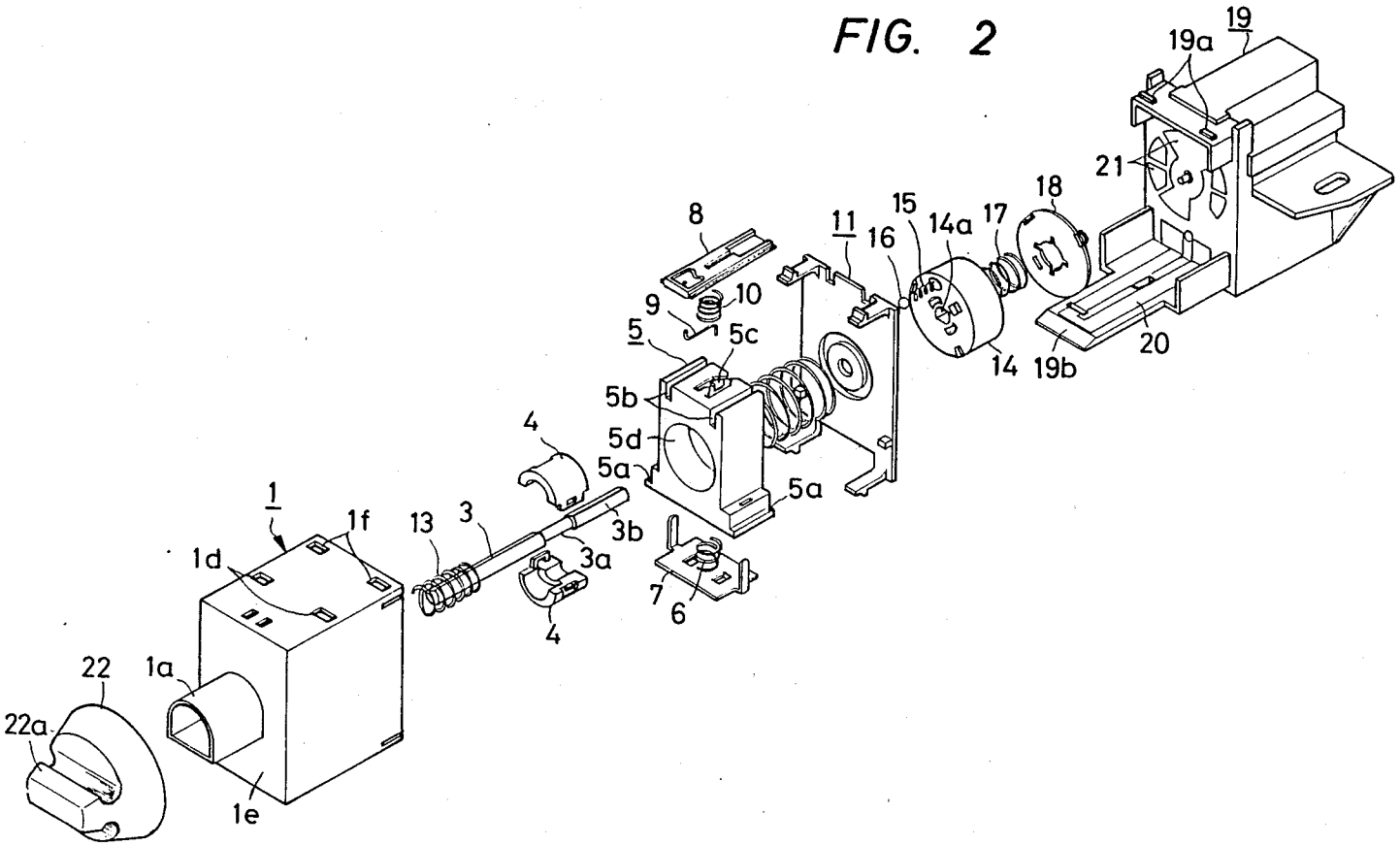
FIG. 2 is an exploded perspective view of the push lock mechanism of the preferred embodiment.

Referring to FIGS. 1 and 2, reference numeral 1 designates a synthetic resin case having an opening at one end thereof. The case 1 is provided at the other end with a cylindrical portion 1*a* to be mounted to an operation panel 2. An operation shaft 3 is inserted centrally of the case 1. The operation shaft 3 has a small-diameter portion 3*a* on which a driving member 4 consisting of a pair of pieces is fixed. Reference numeral 5 designates a slider formed of synthetic resin. The slider 5 is formed at its opposite lower edges with a pair of projections 5*a* to be engaged with a pair of guide channels 1*b* formed on opposite inner side surfaces of the case 1. The slider 5 is further formed on its upper surface with a pair of grooves 5*b* to be engaged with a pair of guide projections 1*c* projecting downwardly from an inner surface of a top wall portion of the case 1. Thus, the slider 5 is guided in the axial direction of the operation shaft 3. A first conductor plate 7 is vertically movably retained through a coil spring 6 to the lower surface of the slider 5. A heart-shaped cam groove 5*c* is formed on the upper surface of the slider 5, and a recess 5d is formed on the front surface of the slider 5 for receiving the driving member 4.

A holder 8 is retained to the inner surface of the top wall portion of the case 1, and a driving pin 9 having a hook-like shape is rockably supported at its one end to the holder 8. The other end of the driving pin 9 is biased by a coil spring 10 to engage the heart-shaped cam groove 5*c*. A partition board 11 is arranged on the rear side of the slider 5. The partition board 11 is formed at its four corners with frontward projecting pawls 11*a* to be engaged with stop holes 1d of the case 1. Thus, the partition board 11 is fixedly located at the substantially central position in the case 1. A first return spring 12 is interposed under a compressed condition between the partition board 11 and the slider 5. Thus, the slider 5 is biased toward a front plate 1e of the case 1 (in the direction of the arrow B shown in FIG. 1) by a spring force of the first return spring 12. Further, a second return spring 13 is interposed under a compressed condition between the driving member 4 and the front plate 1e of the case 1. Thus, the driving member 4 is biased in such a direction as to abut against the slider 5 (in the direction of the arrow A shown in FIG. 1) by a spring force of the second return spring 13. The spring force of the first return spring 12 is set to be greater than that of the second return spring 13. Therefore, under an unlocked condition where the operation shaft 3 is not depressed, the slider 5 receives the driving member 4 to abut against the front plate 1*e* of the case 1.

A rotary member 14 is arranged on the rear side of the partition board 11. The rotary member 14 is formed at its central position with an elongated hole 14*a* to be engaged with a connecting portion 3*b* formed at the rear end portion of the operation shaft 3. The connecting portion 3*b* has a cross section corresponding to that of the elongated hole 14*a*, and is axially slidably received in the elongated hole 14*a*. A ball 16 is retained through a spring 15 to a front surface of the rotary member 14, and is releasably engaged with a stepped click portion 11*b* projecting from a rear surface of the partition board 11. A second conductor plate 18 is retained through a coil spring 17 to a rear surface of the rotary member 14, and a base block 19 formed of synthetic resin is arranged on the rear side of the second conductor plate 18. The base block 19 is formed at its four positions on the upper and lower surfaces thereof with projections 19*a* to be engaged with stop holes 1*f* of the case 1. Thus, the base block 19 is fixed to the case 1 to close the rear opening of the case 1. The base block 19 is integrally formed at its lower portion with a support portion 19*b* projecting frontwardly. A first terminal unit 20 is mounted on a horizontal surface of the support portion 19*b* by outsert forming, and a second terminal unit 21 is mounted on a vertical surface of the base block 19 perpendicular to the support portion 19*b* by outsert forming. The first terminal unit 20 extends near the front plate 1e along the inner surface of the bottom wall of the case 1, and the first conductor plate 7 is slid on the first terminal unit 20 to effect switching operation. On the other hand, the second conductor plate 18 faces the second terminal unit 21, and is rotatably slid thereon to effect switching operation. Reference numeral 22 designates a handle having a finger handling portion 22*a*. The handle 22 is press-fitted to a front end portion of the operation shaft 3 projecting frontwardly from the operation panel 2.

There will now be described the operation of the preferred embodiment with reference to FIGS. 1, 3(*a*) and 3(*b*).

Under the unlocked condition shown in FIG. 1, the driving member 4 is fully received in the recess 5*d* of the slider 5, and both the driving member 4 and the slider 5 are urged against the front plate 1*e* of the case 1 since the spring force of the first return spring 12 is greater than that of the second return spring 13. The handle 22 fixed at the front end of the operation shaft 3 is sufficiently spaced from the operation panel 2. Under the condition, when the finger handling portion 22*a* of the handle 22 is pinched and rotated, the rotary member 14 and the second conductor plate 18 are rotated about the operation shaft 3. As a result, a contact 18a formed on the second conductor plate 18 is brought into contact with or separation from the second terminal unit 21 according to a rotative angle of the rotary member 14, thus effecting the switching operation. In the switching operation, the ball 16 is brought into engagement or disengagement with the stepped portion 11*b* in association with the rotation of the rotary member 14. Therefore, an operator may recognize ON/OFF of the switching with a desired click feeling.

When the handle 22 is pushed under the unlocked condition shown in FIG. 1 to move the operation shaft 3 in the direction of the arrow A, the driving member 4 interlocking with the operation shaft 3 urges the slider 5 against the first return spring 12. Thus, the operation shaft 3, the driving member 4 and the slider 5 are moved together in the direction of the arrow A. The movement of the slider 5 causes sliding of the first conductor plate 7 retained to the lower surface of the slider 5 on the first terminal unit 20, thereby effecting the switching operation. At the same time, a relative position between the driving pin 9 and the heart-shaped cam groove 5*c* formed on the upper surface of the slider 5 is changed, and when a given stroke of the movement of the slider 5 is reached, the driving pin 9 comes into a locked position of the heart-shaped cam groove 5*c*, thus maintaining the slider 5 under a locked condition. FIG. 3(*a*) shows the locked condition of the slider 5. As apparent from FIG. 3(*a*), the slider 5 is maintained in the locked position by means of the aforementioned cam lock mechanism. Under the locked condition, the driving member 4 is biased by the second return spring 13 to abut against the slider 5, and the handle 22 is maintained in a position near the operation panel 2.

Under the locked condition of the slider 5, the handle 22 is rotatable to permit the switching operation by the second conductor plate 18. For example, when the handle 22 is pulled during rotation thereof to apply a force to the operation shaft 3 in the direction of the arrow B, the driving member 4 compresses the second return spring 13 to be moved in the direction of the arrow B, but the slider 5 is maintained under the locked condition by the engagement of the driving pin 9 with the heart-shaped cam groove 5c. Therefore, the driving member 4 only is moved away from the slider 5.

When the pulling force applied to the operation shaft 3 is removed, the driving member 4 is returned by the spring force of the second return spring 13 to abut against the slider 5. As a result, the driving member 4, the operation shaft 3 and the handle 22 are returned to the condition shown in FIG. 3(*a*).

Figure 3:
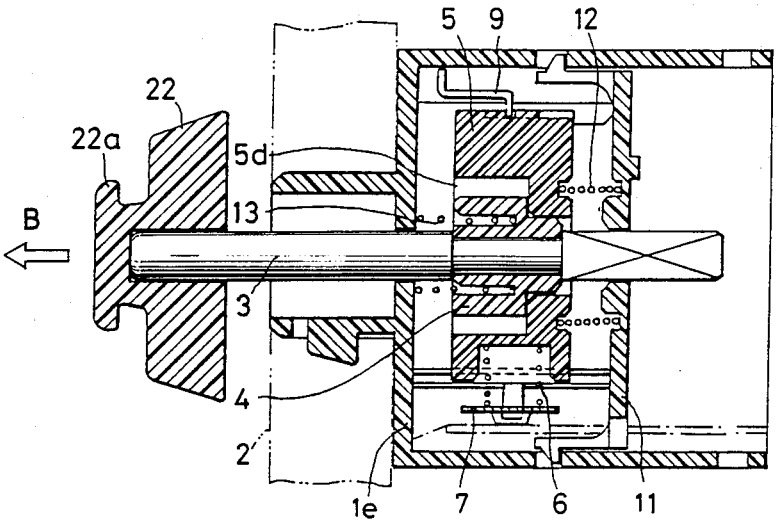
FIG. 3(*a*) is a vertical sectional view of the essential part of the push lock mechanism under the locked condition.
Figure 3:
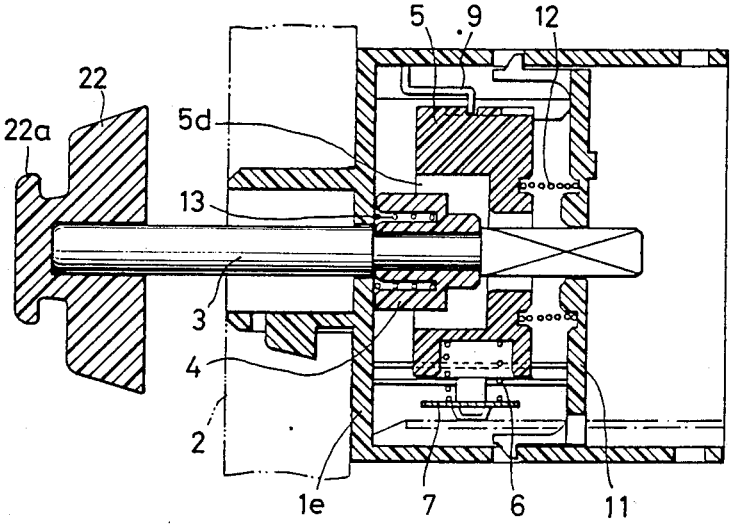

When the handle 22 under the condition shown in FIG. 3(*a*) is further pushed in the direction of the arrow A, the slider 5 is urged by the driving member 4 to make the driving pin 9 be shited from the locked position of the heart-shaped cam groove 5c to the unlocked position thereof. As a result, all of the slider 5, the driving member 4 and the operation shaft 3 are returned to the unlocked condition shown in FIG. 1 by the spring force of the first return spring 12.

As mentioned above, when the operation shaft 3 is pulled under the locked condition of the slider 5, the slider 5 is not moved but the driving member 4 only is independently moved. Accordingly, there is no possibility that undue force due to such a pulling force applied to the operation shaft 3 is applied to the engaged portion between the heart-shaped cam groove 5c and the driving pin 9. As a result, it is possible to prevent the deformation of the driving pin 9 and the breakage of the heart-shaped cam groove 5c, thereby ensuring the locking function of the cam lock mechanism for a long period of time. Further, since the pulling operation of the operation shaft 3 is not hindered by the locked condition of the slider 5, the handle 22 may be formed with a suitable projection such as the finger handling portion 22a, thus allowing various designs of the handle 22. Further, in the normal push lock operation, the driving member 4 is received in the recess 5d of the slider 5, and both members 4 and 5 are reciprocated together. Therefore, it is possible to prevent that the switch is enlarged in the axial direction of the operation shaft 3.

Although the driving member 4 composed of two pieces is fixed to the operation shaft 3 in the above-mentioned preferred embodiment, it is sufficient that the driving member 4 can be reciprocated together with the operation shaft 3 to transmit the power between the operation shaft 3 and the slider 5. For example, the operation shaft 3 may be formed with a flange serving as the driving member 4.

While the invention has been described with reference to a specific embodiment, the description is illustrative and is not to be construed as limiting the scope of the invention. Various modifications and changes may occur to those skilled in the art without departing from the spirit and scope of the invention as defined by the appended claims.

What is claimed is:

1. In a push lock mechanism including a heart-shaped cam groove, a driving pin adapted to trace in said heart-shaped cam groove, and an axially reciprocable operation shaft, wherein said operation shaft moves axially between a non-depressed and a depressed position thereof, and said operation shaft is adapted to lock in said depressed position thereof by cooperation of said heart-shaped cam groove and said driving pin; the improvement comprising a slider having said heart-shaped cam groove on its peripheral surface and arranged around said operation shaft, a first return spring for biasing said slider toward said non-depressed position of said operation shaft, a driving member provided so as to project from said operation shaft for transmitting power between said operation shaft and said slider, and a second return spring for biasing said driving member in such a direction as to urge said driving member against said slider, said second return spring having a spring force set to be smaller than a spring force of said first return spring, wherein when said operation shaft is locked in said depressed position thereof and said slider is moved toward said non-depressed position of said operation shaft, said driving member is moved away from said slider.

2. The push lock mechanism as defined in claim 1, wherein said slider is provided with a recess for receiving said driving member.

* * * * *

UNITED STATES PATENT AND TRADEMARK OFFICE

CERTIFICATE OF CORRECTION

PATENT NO. : 4,916,276

DATED : April 10, 1990

INVENTOR(S) : Shinji Sasaki

It is certified that error appears in the above-identified patent and that said Letters Patent is hereby corrected as shown below:

On the title page, item [75]

Inventor's name -"Shiniji" should read --Shinji--.

Assignee - should read --Alps Electric Co., Ltd.--

Signed and Sealed this

Sixteenth Day of July, 1991

*Attest:*

*Attesting Officer*

HARRY F. MANBECK, JR.

*Commissioner of Patents and Trademarks*